US010888867B2

(12) United States Patent
Schenk

(10) Patent No.: US 10,888,867 B2
(45) Date of Patent: Jan. 12, 2021

(54) CRUSHING DEVICE PROVIDED WITH AN EXHAUST SYSTEM AND METHOD FOR CRUSHING HETEROGENEOUS CHUNKS OF MATERIAL

(71) Applicant: Oijense Bovendijk B.V., Oijen (NL)

(72) Inventor: Koos Jacobus Schenk, Oijen (NL)

(73) Assignee: OIJENSE BOVENDIJK B.V., Oijen (NL)

( * ) Notice: Subject to any disclaimer, the term of this patent is extended or adjusted under 35 U.S.C. 154(b) by 526 days.

(21) Appl. No.: 15/547,329

(22) PCT Filed: Jan. 29, 2016

(86) PCT No.: PCT/NL2016/050069

§ 371 (c)(1),
(2) Date: Jul. 28, 2017

(87) PCT Pub. No.: WO2016/122324

PCT Pub. Date: Aug. 4, 2016

(65) Prior Publication Data

US 2018/0008986 A1 Jan. 11, 2018

(30) Foreign Application Priority Data

Jan. 29, 2015 (NL) ..... 2014209

(51) Int. Cl.
*B02C 1/06* (2006.01)
*B02C 23/24* (2006.01)
(Continued)

(52) U.S. Cl.
CPC ..... *B02C 1/06* (2013.01); *B02C 1/00* (2013.01); *B02C 1/04* (2013.01); *B02C 23/24* (2013.01);
(Continued)

(58) Field of Classification Search
CPC .... B02C 1/04; B02C 1/00; B02C 1/06; B02C 1/043; B02C 23/24; B02C 23/30; B02C 23/26
(Continued)

(56) References Cited

U.S. PATENT DOCUMENTS 5,462,237 A * 10/1995 Wellmann ..... B02C 1/02 241/57
6,827,301 B1 * 12/2004 Kassuba ..... B02C 1/005 241/266
(Continued)

FOREIGN PATENT DOCUMENTS

DE 619810 C 10/1935
DE 93 05 202 U1 8/1994
(Continued)

OTHER PUBLICATIONS

PCT/NL2016/050069 International Search Report.

*Primary Examiner* — Faye Francis
(74) *Attorney, Agent, or Firm* — Roberts & Roberts, LLP

(57) ABSTRACT

A crushing device and a method for crushing materials therewith. The crushing device includes a jaw crusher having two jaws, wherein at least one jaw moves reciprocally toward the other jaw and away from the other jaw when in use, a supply device for supplying material to be crushed to the jaw crusher, and a discharge device for discharging crushed material. The crushing device includes a housing that encloses the jaw crusher, a ventilation device provided with air outlet openings that open into the crushing space, by means of which ventilation device air can be blown under pressure between the jaws of the jaw crusher device, and an exhaust device, which exhausts air mixed with fine material produced by the jaw crusher from the housing. The exhaust
(Continued)

device is configured to convey the fine material mixed with the air to a collecting location.

20 Claims, 1 Drawing Sheet

(51) Int. Cl.

| | |
|---|---|
| ***B02C 1/00*** | (2006.01) |
| ***B02C 23/26*** | (2006.01) |
| ***B02C 23/30*** | (2006.01) |
| ***B02C 23/40*** | (2006.01) |
| ***B02C 1/04*** | (2006.01) |

(52) U.S. Cl.
CPC ..... *B02C 23/26* (2013.01); *B02C 23/30* (2013.01); *B02C 23/40* (2013.01)

(58) Field of Classification Search
USPC ..... 241/57, 262–269
See application file for complete search history.

(56) References Cited

U.S. PATENT DOCUMENTS

| | | | | |
|---|---|---|---|---|
| 2013/0233949 | A1 | 9/2013 | Schmandra et al. | |
| 2014/0231555 | A1* | 8/2014 | Baetz | B02C 23/08 241/19 |
| 2017/0239666 | A1* | 8/2017 | Kawaguchi | C01B 33/02 |

FOREIGN PATENT DOCUMENTS

| | | | |
|---|---|---|---|
| DE | 93 05 303 | U1 | 8/1994 |
| DE | 196 19 411 | A1 | 11/1997 |
| EP | 1 732 693 | A1 | 1/2011 |
| WO | 2011/142663 | A1 | 11/2011 |
| WO | 2011/161252 | A1 | 12/2011 |

* cited by examiner

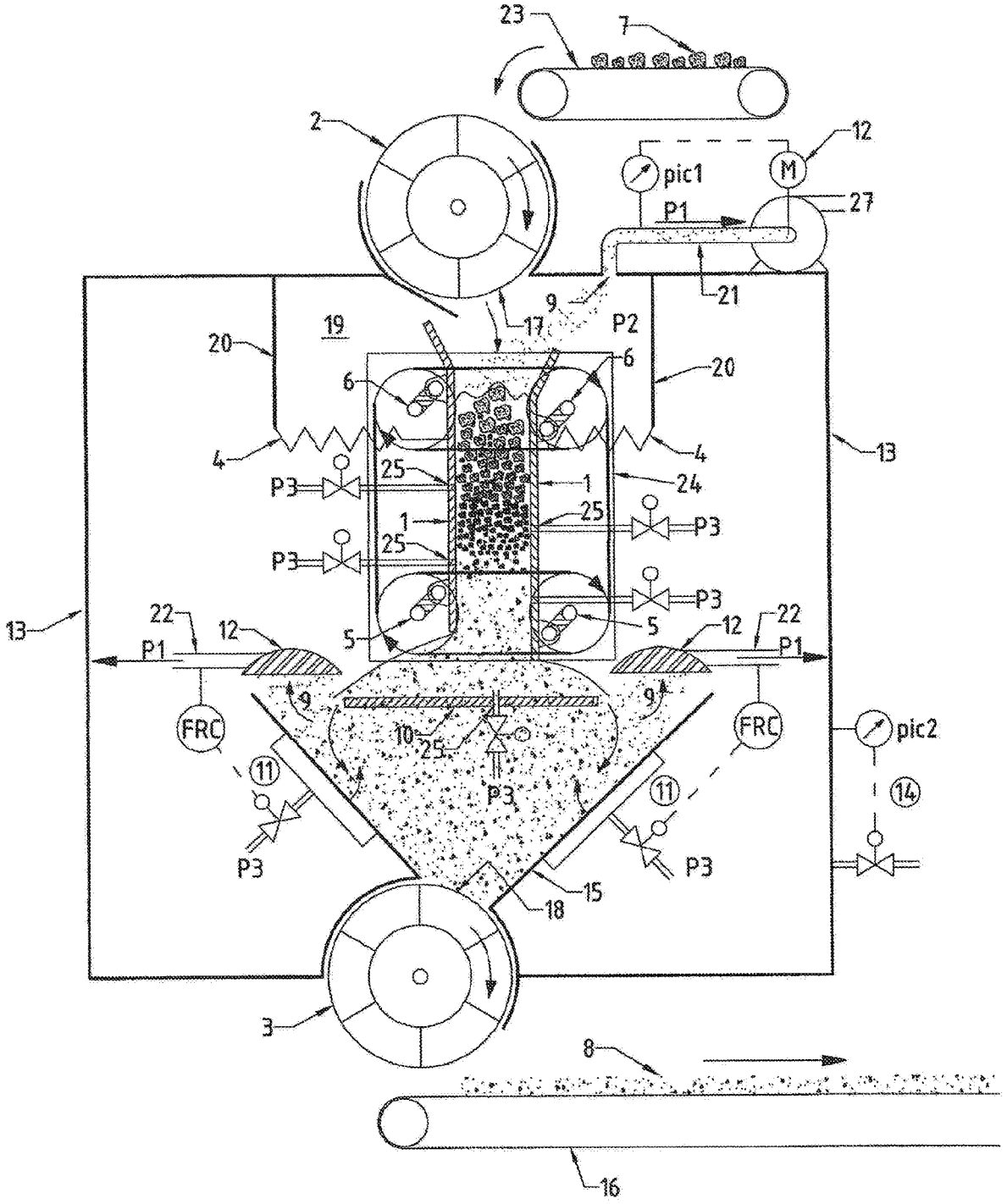
23
7
2
12
pic1
M
27
P1
21
9
P2
17
19
20
6
20
6
4
4
13
25
1
24
P3
1
25
P3
P3
25
P3
13
22
12
5
5
12
22
P1
P1
9
9
FRC
FRC
pic2
10
25
11
11
14
P3
P3
P3
15
18
3
8
16

CRUSHING DEVICE PROVIDED WITH AN EXHAUST SYSTEM AND METHOD FOR CRUSHING HETEROGENEOUS CHUNKS OF MATERIAL

According to a first aspect, the present invention relates to a crushing device configured to crush heterogeneous chunks of material, said crushing device comprising a crusher of the jaw crusher type provided with two jaws, at least one jaw of which moves reciprocally toward the other jaw and away from the other jaw in use so as to crush material that is present between the jaws, which jaws define a crushing space together with two bounding elements extending beside the jaws, parallel to the direction of reciprocation of the at least one jaw, a supply device configured to supply the material to be crushed to the jaw crusher and a discharge device configured to discharge material processed, i.e. at least partially crushed, by the jaw crusher, wherein the material flows from the supply device, through the crushing space, to the discharge device in a downstream direction of flow. The term "heterogeneous chunk of material" as used herein is understood to mean solid matter composed of two or more substances or materials, such that the substances, or at least part of the substances or materials, can be mechanically separated, i.e., wherein the bond between two adjacent particles or chunks of material can be broken by mechanical means. Hereinafter this process will be referred to as selective crushing (i.e. essentially at the location of the bond between a particle and another particle or chunk). Think in this connection of a chunk of concrete, for example, which can be separated into pebbles, sand and hydrated and unhydrated cement, or of slag that can be separated into metal and fly ash, cinder and minerals.

A crushing device as described in the introduction is known, for example from WO 2011142663 A1. Said known crushing device is for example shown in FIGS. 1 and 7 and described on page 1, lines 22-page 10, line 1 and on page 13, line 23-page 14, line 34, which passages are incorporated herein by reference. The known crushing device, which was developed for crushing and separating concrete into the original gravel pebbles, sand and hydrated and unhydrated cement comprises two jaws that can move toward and away from each other, which jaws, together with sidewalls, define a crushing space. Upon movement of the jaws toward each other, material that is present in the crushing space is selectively crushed. Upon movement of the jaws away from each other, crushed material partially drops down in the direction of the discharge device and room is made in the crushing space for the supply of material to be crushed. An outlet restriction is provided under the jaws so as to restrict the outflow of crushed material.

A drawback of known crushing devices is that a mass of crushed material accumulates at the bottom, between the jaws and under the jaws before the discharge device. During crushing, the material is unnecessarily crushed into increasingly smaller parts and particles between the jaws. The smallest particles and the particles having a relatively high specific weight drop down relatively quickly between the jaws in the direction of the discharge device in comparison with the larger parts. With the crushing device known from WO 2011142663 A1, this effect occurs even more than with traditional jaw crushers, because the crushing device in question provided with the outlet restriction is suitable for converting concrete to be crushed back into the original materials of which the concrete is composed (other known crushing devices crush the concrete into small heterogeneous particles of concrete instead of into the original homogeneous materials). The effect of the difference in specific weight is thus stronger in comparison with the other known crushing devices, because the individual selectively crushed homogeneous elements have dimensions and a specific weight different from those of the heterogeneous parts of materials in the other known crushing devices. With the crushing device known from WO 2011142663 A1, but also with other more traditional jaw crushers, there is a risk that the effectiveness of the crushing movement decreases because relatively small particles of (essentially heterogeneous) crushed material absorb much of the energy generated by the jaw movement, which energy could be used more advantageously for separating, by further crushing, any relatively large lumps/chunks of material yet to be crushed. When concrete is crushed by means of the crushing device known from WO 2011142663 A1, an additional risk occurs, viz. that of an unwanted reaction between hydrated and unhydrated cement, two materials which should preferably be separated as much as possible and which can indeed be separated by selective crushing.

The object of the present invention according to a first aspect thereof is to provide a crushing device as described in the introduction wherein the aforesaid risks are eliminated or at least alleviated. According to the present invention this object is achieved with a crushing device according to claim 1. During operation of the crushing device, the ventilation device continuously or intermittently blows air, preferably from outside the housing, through the air outlet openings into the space between the jaws, at least one of which moves in reciprocating motion. The air that is blown in has an upstream direction, or in other words, a direction having an upward component. The air is preferably blown into the crushing space via the air outlet opening and through at least one of the jaws or through a sidewall functioning as a bounding element, which is disposed beside the jaws so as to define a crushing space together with the jaws. The air blows fine particles out of the crushed material and material to be crushed that is present between the jaws in upstream direction. Since the air outlet opening opens into the crushing space, preferably directly, direct injection of air into the matter present in the crushing space is realised. In particular small particles having a relatively low specific weight are thus blown away in upstream direction, i.e. against the main flow of the material to be crushed, from the material to be crushed and from between the jaws. The housing encloses the jaws and is thus configured to keep the particles that are released from the material to be crushed or are loosened by the ventilation device within a space defined by the housing. The housing must thus not be confused with a space which is (only) defined by walls that form part of a building. The housing may be constructed from metal, wooden or plastic partitions which are joined together, thus forming a box structure surrounding the jaw crusher. A surface on which the jaw crusher is placed can function as a bottom wall for the housing. The housing is preferably erected within a space of a building and is preferably dimensioned so that the presence of staff within the housing during operation of the crushing device is undesirable and in fact irresponsible. The exhaust device is in communication with the interior of the housing, exhausts air containing loosened and released particles from the housing and thus conveys the particles in question to a collecting location where the particles in question are collected. For example, when concrete is crushed, the particles that are thus exhausted will mainly comprise particles having a relatively low density, particles of hydrated cement in that case. Like sand, unhydrated cement has a relatively high density and will thus be mainly collected at the bottom of the crushing device and be discharged via the (regular) discharge device under the jaw crusher. Since the hydrated cement is at least in large part exhausted from the space, said small particles will not collect at the bottom between the jaws or at least before the discharge device. As a result, the portion of small particles at the discharge device, and thus the risk of clogging, will decrease. In addition, because of the relatively early separation of hydrated and unhydrated cement, the risk of a reaction occurring between the two types of particles is reduced. The objects according to the first aspect of the present invention are thus achieved.

In a preferred embodiment of the present invention, the jaw crusher device is at least substantially hermetically sealed from the environment by the housing, at least with the exception of ventilation and exhaust devices. A substantially hermetic seal makes it possible to create an overpressure within the housing relative to the surrounding atmosphere by means of the ventilation device, so that air with the fine material mixed therein can be exhausted from the housing by an exhaust device. At locations where there are leaks to the surrounding atmosphere in the housing, air containing fine particles could escape from the housing, so that the fine particles in question would be lost rather than be conveyed to the collecting location.

In a preferred embodiment of the present invention, the supply device is of the lock type. That is, while material is being supplied to the jaw crusher from outside the housing, the supply device provides no or virtually no open communication between the housing and the atmosphere surrounding the housing. A valve and/or material in the supply device shuts off or excludes such communication. The supply device is preferably of the rotary lock type, in which a wheel divided into compartments rotates within the housing, which compartments receive supply material from outside in succession and deliver it after a partial revolution of the wheel within the housing. In its rotary motion, the wheel substantially sealingly bears against the housing of the rotary lock. In this way air containing particles is in large measure prevented from escaping from the housing via the inlet.

In a preferred embodiment of the present invention, the discharge device is of the lock type. A lock-type discharge device prevents air flowing freely through the discharge device to outside the housing, for example in the case of an overpressure inside the housing relative to the surrounding atmosphere. The discharge device may be of the rotary lock type.

The air outlet opening is preferably provided in a jaw or in a bounding element and opens into the crushing space, preferably in a central part (seen in vertical direction) of a jaw or a bounding element. The term "central part" is understood to mean a part located so low that the air outlet opening opens into the crushing space at the level of the material to be crushed in use of the crushing device and so high that the air from the air outlet opening can flow through to above the material to be crushed, and that with sufficient force for carrying along the fine particles. The central part can be regarded as the part between the upper quarter and the lower quarter of the jaw or the bounding element.

The housing preferably comprises one or more circumferential walls which define a cross-sectional area parallel to the horizontal at most five times, preferably at most three times, more preferably at most two times greater than a perpendicular projection on a ground surface of the jaw crusher, with the jaws moved apart, and a discharge buffer device located downstream of the jaw crusher and upstream of the discharge device. The housing need not be (much) larger than necessary for keeping air mixed with fine material within the housing. In principle it is true that the smaller the space defined by the housing, the greater the concentration of fine material in the air within the housing. The fine material can thus be exhausted in a relatively efficient manner. As a matter of fact, the extent to which and the speed at which air is blown into the material already crushed and/or to be crushed will have to be determined more or less by experiment, such that the desired component, for example hydrated cement, will be blown out of the material and other components will largely remain in the material flow. These values may vary with each ventilation device and may also depend on the composition of the material to be crushed.

It is preferable that at least one further ventilation device is provided, which further ventilation device is configured and disposed to blow air through material already crushed and/or to be crushed by the jaw crusher. If such a further ventilation device opens directly into the crushing space, which is preferred, more air can be blown through the material flow and that at more locations. A further ventilation device may also open into the housing outside the crushing space, however. The fact is that it is possible, if not probable, that fine material will already or still be present at other locations than between the jaws. By blowing air into the material flow at the locations in question, using a further ventilation device, the particles in question can also be blown out of the material at these locations in order to be exhausted.

It is preferable that at least one further exhaust device is provided, which further exhaust device is configured and disposed to exhaust air mixed with fine material produced by the jaw crusher from the housing. The (first) exhaust device is preferably disposed above the crushing space, as this is the place where air blown into the housing in upstream direction by the (first) ventilation device, which air contains a relatively great deal of particles of fine material, is released. Air mixed with fine material may also be exhausted from the housing at other locations within the housing, however. If further ventilation devices are provided, it is preferable that further exhaust devices are disposed at locations where air from further ventilation devices, mixed with fine material, is released from the material flow.

If an air pressure sensor is provided which is configured and disposed to measure the pressure prevailing in the housing, it is possible to measure an overpressure in the housing relative to the surrounding atmosphere so as to thus study the ventilation device(s) and/or the exhaust device(s).

In a preferred embodiment of the present invention, a flexible seal extends between at least one of the circumferential walls of the jaw crusher, comprising the jaws, and the housing, which seal separates a space provided with an inlet located above the crushing jaws of the jaw crusher from a space provided with an outlet located under the crushing jaws of the jaw crusher. The flexible wall separates a space above the jaws from a space under the jaws, wherein the flexibility of the wall enables the flexible wall to move along with the movement of the jaw in question and thus provide a continuous seal. In this way, air mixed with particles is prevented from finding its way into the space under the crushing space from the space above the crushing space, where air is exhausted by the exhaust device. As a result, a relative overpressure prevailing above the crushing space cannot be neutralized by a relative underpressure prevailing under the jaw crusher. Because the cement stone, which is relatively soft and thus easy to crush or pulverise, is exhausted from the crushing chamber, pulverization will not continue unnecessarily and the crushing energy will remain available for crushing material that must actually be crushed.

If an obstruction device, that is, a device which restricts the outflow of crushed material from the jaw crusher device and preferably urges it back in part, is provided under an outlet of the jaw crusher, the material will be kept in the crushing space for a relatively long time. This can for example result in a better separation and grading of original components of the crushed material, as for example discussed with reference to the crushing device known from WO 2011142663 A1. If concrete is crushed in such a manner, it can thus be separated better into pebbles, hydrated cement stone, unhydrated cement and any other alternatives, wherein the hydrated cement stone can thus be exhausted according to the present invention.

A hopper functioning as a discharge buffer device may be provided under an outlet opening of the jaw crusher. The discharge buffer device can function as a lock for the discharge device. Moreover, or alternatively, the discharge buffer device may be provided for generating a continuous discharge flow of material from the jaw crusher device.

In a preferred embodiment of the present invention, a control device is provided which is configured to control the extent to which air is blown into the material by one or more ventilation devices and/or to control the extent to which air is exhausted by one or more exhaust devices. The control device may be a manual control device and may be combined with sensors, for example an air pressure sensor present within the housing, wherein the ventilation devices and/or the exhaust devices are controlled in dependence on values measured by one or more sensors.

It is preferable in that regard if an analysis sensor is provided which is configured and disposed to analyse the quality of material exhausted by the exhaust device. The analysis sensor may for example be an NIR sensor. If several exhaust devices are provided, an analysis sensor may be provided for each one of said exhaust devices and different ventilation devices and/or exhaust devices may be separately adjusted and/or controlled. Thus it is possible to reduce the velocity of the air blown in by the ventilation device if the hydrated cement stone being exhausted is contaminated with other materials to an extent that exceeds a set value, so that heavier particles will be released less easily from the material flow. Conversely, a (too) high degree of purity may be reason to increase the aforesaid velocity.

According to a second aspect, the present invention relates to crushing heterogeneous chunks of material into small parts and separate the same into discharge flows, comprising the steps of:

a) providing a crushing device according to one or more of the above-described claims;

b) supplying material to be crushed to a crushing space bounded by the jaws of the jaw crusher via the supply device;

c) crushing material present in the crushing space while air is being blown into the crushing space by the ventilation device;

d) exhausting fine material mixed with the air by means of the exhaust device and conveying said material to a collecting location; and e) discharging processed, i.e. at least partially crushed material from the crushing device via the discharge device.

Using a method according to the second aspect of the present invention, an advantage is obtained which corresponds to the advantage discussed in the foregoing in relation to the first aspect of the present invention.

The present invention will now be described in more detail with reference to a schematic embodiment of the present invention as shown in FIG. 1.

FIG. 1 is a schematic view of a crushing device according to the present invention. The crushing device comprises two crushing jaws 1, which extend parallel to each other in vertical direction in FIG. 1. The two crushing jaws 1 are moved reciprocally toward and away from each other, in a manner that is known per se, by means of pivot arms 5, 6 in the form of eccentric shafts. During said reciprocal motion, the upper ends of the crushing jaws 1 are moved essentially away from each other by the upper pivot arms 6, whilst the lower ends of the crushing jaws 1 are moved toward each other by the lower pivot arms 5, and vice versa. The crushing jaws 1 move between a position as shown in FIG. 1 and a position in which the crushing jaws 1 converge from the top to the bottom to a more funnel-shaped configuration. In this way a crushing space of constantly varying diameter for receiving new material 7 to be crushed, which is supplied by the conveyor 23, is formed under an upper metering lock 2, which functions as a supplying device, by the crushing jaws 1 functioning as side walls 24 (of which only the side wall behind the crushing jaws is shown in the FIGURE), whereupon the crushing jaws 1 move toward each other for crushing material present between the crushing jaws 1. During operation of the crushing device, material that is present between the crushing jaws 1 drops down while being crushed to an increasing extent. Disposed under the crushing jaws 1 is an obstruction device 10, in this case in the form of a plate 10 which extends horizontally under the crushing jaws 1, which obstruction device generates a partial obstruction of the through-flow. The obstruction device 10 causes the through-flow of the material between the crushing jaws 1 to slow down so as to improve the final result of the crushing device. Refer in this regard to the description of the method on page 8, lines 1-31 of International patent application WO 2011/142663 A1. Via the obstruction device 10, the crushed material flows into a receiving hopper 15 and subsequently through the rotary lock 3, which function as a discharge device, to a conveyor 16, which discharges the crushed material 8 for further processing. With the exception of an inlet opening 17, into which the metering lock 2 opens, and an outlet opening 18, which opens into the metering lock 3, the jaw crusher with the hopper 15 is entirely enclosed by a housing 13. The housing 13 is a rectangular block shape of circumferential walls of steel plate, in which the rotary locks 2 and 3 are integrated. The housing 13 may be supported on standards or the like. Shown within the housing 13 is an upper chamber 19, which is bounded by part of an upper wall of the housing 13, a vertical partition 20 and a flexible wall 4 which extends between the vertical partition 20 and the crushing jaws 1. The wall 4 is of the accordion type and is connected to the static vertical partition 20 on one side and to the reciprocating crushing jaws 1 on the other side. A discharge channel 21 connects to the upper chamber 19, to which discharge channel an exhaust device 12 is connected, which exhaust device generates an underpressure in the discharge channel 21 relative to the prevailing pressure in the upper chamber 19 for the purpose of exhausting the mixture of air and light particles 9 in a direction P1. In use, air is blown through air outlet openings 25 into the space between the crushing jaws 1 via ventilation devices P3. As a result, fine particles 9 are blown out of material that is present between the crushing jaws 1, whilst in addition a relative overpressure is created in the upper chamber 19. Because air is withdrawn from the chamber 19 through the discharge channel 21 in the exhaust direction P1, an air flow is created from the space between the crushing jaws 1 to the discharge channel 21, in which air flow light particles 9 are carried along. When the crushing device is used for crushing concrete, said light particles are in particular relatively light particles of hydrated cement, which are led to a discharge location (not shown) or a collecting location in the form of a silo (symbolically indicated at 27) via the discharge channel 21. In said silo, the hydrated cement is connected.

In this exemplary embodiment, air is also blown into the crushed material collected in the hopper 15 via the air inlets P3 in the wall of the hopper 15. Exhaust devices 12 are provided above the hopper 15, at the location where crushed material flows into the hopper 15 via the obstruction device 10, which exhaust devices exhaust air mixed with fine particles 9 as fine material from the crushed material via a discharge channel 22, in a similar manner as with the discharge channel 21, and carry said material to the discharge location (not shown) in the form of a silo. Small particles 9, particles of hydrated cement in the case of concrete being crushed, carried along with the flow of material between the crushing jaws 1 in the direction of the obstruction device 10 and the hopper 15, can thus be removed from the crushed material yet. The crushed material, from which a large portion of the small particles, small particles of hydrated cement in the case of concrete being crushed, has been removed, flows into the metering lock 3 via the hopper 15 and is conveyed ahead on the conveyor 15 for further processing. In FIG. 1, the conveyor 23 is positioned above the metering lock 2 in such a manner that material that drops from the conveyor 23 into the metering lock 2 will automatically cause the metering lock 2 to rotate under the influence of the force of gravity. It will be understood that the metering lock 2 is configured so, that leakage of air from the chamber 19 to outside the housing 14 is minimised by using a relative overpressure. Likewise, the hopper 15 is positioned in such a manner relative to the metering lock 3 that crushed material 8 that finds its way from the hopper 15 into the metering lock 3 will automatically set the metering lock 3 moving. The crushed material collected in the hopper 15 and also the metering lock 3 restrict any flow of air from inside the housing 13 to outside the housing 13. Pressure sensors (P1C1, P1C2) are provided both inside and outside the housing 13, which sensors measure the local air pressure on the basis of which the air inlets P3 and the air exhaust devices P1 can be controlled.

In the figures and the above description thereof, the present invention is shown and described with reference to only one embodiment of a crushing device according to the present invention. It will be understood, however, that many variants, which may or may not be obvious to the skilled person, are conceivable within the scope of the present invention as defined in the appended claims. Thus, in particular the crushing of concrete and the associated separation of hydrated cement (stone) are discussed in the exemplary embodiment. It is also possible, however, to crush other materials, for example slag, using a crushing device according to the present invention, with other particles, such as fly ash particles, for example, being exhausted by means of the exhaust devices. Furthermore, the description concerns a specific jaw crusher device which is in particular configured for selectively crushing concrete. Of course it is also possible within the scope of the present invention to use other types or versions of jaw crushers. The supply of material to be crushed and/or the discharge of crushed material can be realised by means of lock types other than rotary locks. If use is made of an overpressure within the housing relative to a prevailing pressure outside the housing, open communication between the space inside the housing and the space outside the housing, for example via an inlet or outlet opening, is preferably prevented. In the FIGURES, specific locations for the supply and exhaust of air are indicated. It will be understood that these positions can be adapted to a specific situation in dependence on the use and the air flows to be expected.

The invention claimed is:

1. A crushing device configured to crush heterogeneous chunks of material, said crushing device comprising a jaw crusher provided with two jaws, wherein at least one of said two jaws moves reciprocally toward the other of said two jaws and away from the other of said two jaws when in use, so as to crush material that is present between said two jaws, and wherein said two jaws define a crushing space together with two bounding elements extending beside said two jaws, parallel to a direction of reciprocation of at least one of said two jaws, a supply device configured to supply the material to be crushed to the jaw crusher and a discharge device configured to discharge material processed, which is at least partially crushed, by the jaw crusher, wherein the material flows from the supply device, through the crushing space, to the discharge device in a downstream direction of flow, wherein the crushing device comprises a housing that encloses the jaw crusher, at least one first ventilation device provided with an air outlet opening that opens into the crushing space, which first ventilation device is configured to blow air under pressure between said two jaws of the jaw crusher device such that it then flows in upstream direction into the crushing space, and a first exhaust device which, when in use, exhausts air mixed with fine material produced by the jaw crusher from the housing, wherein the exhaust device is configured to convey the fine material mixed with the air to a collecting location.

2. The crushing device according to claim 1, wherein the jaw crusher device is at least substantially sealed from the environment by the housing.

3. The crushing device according to claim 2 wherein at least one of the supply device and the discharge device comprises a lock.

4. The crushing device according to claim 2 wherein the air outlet opening is provided in a jaw or in a bounding element and opens into the crushing space.

5. The crushing device according to claim 2 wherein the housing comprises one or more circumferential walls which define a cross-sectional area parallel to the horizontal at most five times greater than a perpendicular projection on a ground surface of the jaw crusher, with the jaws moved apart, and a discharge buffer device located downstream of the jaw crusher and upstream of the discharge device.

6. The crushing device according to claim 1 wherein at least one of the supply device and the discharge device comprises a lock.

7. The crushing device according to claim 6 wherein the air outlet opening is provided in a jaw or in a bounding element and opens into the crushing space, in a central part in a vertical direction of a jaw or a bounding element.

8. The crushing device according to claim 6 wherein the housing comprises one or more circumferential walls which define a cross-sectional area parallel to the horizontal at most five times greater than a perpendicular projection on a ground surface of the jaw crusher, with the jaws moved apart, and a discharge buffer device located downstream of the jaw crusher and upstream of the discharge device.

9. The crushing device according to claim 1 wherein the air outlet opening is provided in at least one of said two jaws or bounding element and opens into the crushing space, in a central part in a vertical direction of a jaw or a bounding element.

10. The crushing device according to claim 9 wherein the housing comprises one or more circumferential walls which define a cross-sectional area parallel to the horizontal at most five times greater than a perpendicular projection on a ground surface of the jaw crusher, with the jaws moved apart, and a discharge buffer device located downstream of the jaw crusher and upstream of the discharge device.

11. The crushing device according to claim 1 wherein the housing comprises one or more circumferential walls which define a cross-sectional area parallel to the horizontal at most five times greater than a perpendicular projection on a ground surface of the jaw crusher, with the jaws moved apart, and a discharge buffer device located downstream of the jaw crusher and upstream of the discharge device.

12. The crushing device according claim 11 wherein a flexible seal extends between at least one of the circumferential walls of the jaw crusher, comprising the jaws, and the housing, which seal separates a space provided with an inlet located above the crushing jaws of the jaw crusher from a space provided with an outlet located under the crushing jaws of the jaw crusher.

13. The crushing device according to claim 1 wherein at least one further ventilation device is provided, wherein said at least one further ventilation device is configured and disposed to blow air in upstream direction through material already crushed and/or to be crushed by the jaw crusher.

14. The crushing device according to claim 1 wherein at least one further exhaust device is provided, which further exhaust device is configured and disposed to exhaust air mixed with fine material produced by the jaw crusher from the housing.

15. The crushing device according to claim 1 wherein an air pressure sensor is provided which is configured and disposed to measure the pressure prevailing in the housing.

16. The crushing device according to claim 1 wherein an obstruction device is provided under an outlet of the jaw crusher.

17. The crushing device according to claim 1 wherein a hopper functioning as a discharge buffer device is provided under an outlet opening of the jaw crusher.

18. The crushing device according to claim 1 wherein a control device is provided which is configured to control the extent to which air is blown into the material by one or more ventilation devices to control the extent to which air is exhausted by one or more exhaust devices.

19. The crushing device according to claim 1 wherein an analysis sensor is provided which is configured and disposed to analyse the quality of material exhausted by the exhaust device.

20. A method for crushing heterogeneous chunks of material into small parts and separating the same into discharge flows, comprising the steps of:

a) providing a crushing device according to claim 1;

b) supplying material to be crushed to a crushing space bounded by the jaws of the jaw crusher via the supply device;

c) crushing said material present in the crushing space while air is being blown into the crushing space by the at least one first ventilation device;

d) exhausting fine material mixed with the air by means of the exhaust device and conveying said material to a collecting location; and e) discharging processed crushed material from the crushing device via the discharge device.

* * * * *